US007985032B2

(12) United States Patent
Takahashi

(10) Patent No.: US 7,985,032 B2
(45) Date of Patent: Jul. 26, 2011

(54) PLATEN RETAINING STRUCTURE AND RECORDING UNIT

(75) Inventor: Masanori Takahashi, Chiba (JP)

(73) Assignee: Seiko Instruments Inc. (JP)

( * ) Notice: Subject to any disclaimer, the term of this patent is extended or adjusted under 35 U.S.C. 154(b) by 767 days.

(21) Appl. No.: 12/008,284

(22) Filed: Jan. 10, 2008

(65) Prior Publication Data

US 2008/0178753 A1 Jul. 31, 2008

(30) Foreign Application Priority Data

Jan. 25, 2007 (JP) ..... 2007-015005

(51) Int. Cl.
*B41J 11/04* (2006.01)

(52) U.S. Cl. ..... 400/652; 400/653

(58) Field of Classification Search ..... 400/652; 347/220

See application file for complete search history.

(56) References Cited

U.S. PATENT DOCUMENTS

| | | | | |
|---|---|---|---|---|
| 4,913,567 | A * | 4/1990 | Imamaki et al. | 400/120.16 |
| 5,181,787 | A * | 1/1993 | Hosomi | 400/120.16 |
| 6,249,302 | B1 * | 6/2001 | Sekiya | 347/220 |
| 6,765,602 | B2 * | 7/2004 | Mori | 347/220 |
| 6,899,479 | B2 * | 5/2005 | Hayashi et al. | 400/621 |
| 7,547,153 | B2 * | 6/2009 | Yoshioka | 400/621 |
| 2003/0058327 | A1 | 3/2003 | Louis | 347/220 |
| 2005/0281606 | A1 * | 12/2005 | Koyama et al. | 400/621 |

FOREIGN PATENT DOCUMENTS

| | | |
|---|---|---|
| EP | 1262326 | 12/2002 |
| EP | 1516737 | 3/2005 |

* cited by examiner

*Primary Examiner* — Anthony H. Nguyen
(74) *Attorney, Agent, or Firm* — Adams & Wilks

(57) ABSTRACT

A platen retaining structure has a head, a platen supporting the sheet material during a processing operation of the sheet material by the head, a first urging member urging the head against the platen, and a frame supporting the head and the platen and formed with a notch and a pawl. The notch has a retaining portion that retains a shaft portion and an opening portion opening to an exterior of the frame. The pawl regulates movement of the shaft portion from the retaining portion to the opening portion of the notch. A release arm engages with the shaft portion and is mounted to undergo movement with respect to the frame. A second urging member urges the release arm and moves the release arm along with movement of the head away from the platen against an urging force of the first urging member, and causes the platen to apply a pressing force in a direction in which the shaft portion of the platen escapes from the notch via the opening portion. An urging direction of the second urging member is set as a direction in which the second urging member applies a pressing force to the shaft portion of the platen through the release arm when an urging force applied by the platen through the head from the first urging means is released to thereby move the shaft portion of the platen from the notch.

14 Claims, 7 Drawing Sheets

PLATEN RETAINING STRUCTURE AND RECORDING UNIT

FIELD OF THE INVENTION

The present invention relates to a retaining structure for a platen roller used at a position in contact with a head, and a recording unit including the retaining structure.

DESCRIPTION OF THE RELATED ART

Conventionally, there is a recording unit having inside a casing a recording head and a roller-type platen (platen roller) being in contact therewith, with the recording head performing recording on a recording medium (sheet material) transported by the platen roller. In the recording unit, in a case of performing operations such as setting of the recording medium by inserting it between the recording head and the platen roller, jamming treatment when jamming (so-called paper jam) of the recording medium is caused between the recording head and the platen roller, and replacement and maintenance of the recording head and/or the platen roller, the operations are extremely hard to perform in a state where the recording head and the platen roller remain in contact with each other in the casing. Accordingly, there is provided a construction in which the platen roller and the recording head are separated from each other and are exposed to the exterior of the casing. It is desirable for the recording head, which has a plurality of recording elements (for example, heat generating elements), to be fixed in a position inside the casing so as not to impair the reliability in electrical connection for inputting. recording signals for selectively driving the recording elements. Therefore, there is generally employed a construction in which the platen roller is separated from the recording head and exposed to the exterior, with the recording head being fixed in a position inside the casing.

During a recording operation, it is necessary for the platen roller to be firmly held in contact with the recording head with a predetermined pressure. Thus, in some constructions, a recess is provided in a frame and a shaft portion (portion to be retained) of the platen roller is retained in the recess to thereby perform positioning.

Further, in order to make the platen roller detachable, there is a construction in which, for example, the recess is formed into a slit-like notch toward the exterior of the frame, and an opening portion of the notch to the exterior is an entrance portion through which the platen roller is let in and out. This construction is advantageous in that the platen roller is detachable. However, the construction requires a structure for firmly retaining the platen roller at a retaining position so that the platen roller does not inadvertently escape from the notch and the platen roller is brought into contact with the recording head with the predetermined pressure during the recording operation.

As the structure for preventing the platen roller from inadvertently escaping from the notch, first, it is possible to employ a structure in which the width of the slit-like notch in the vicinity of the opening portion is set to be equal to or a little narrower than an outer diameter of the shaft portion of the platen roller. In this case, when the platen roller is attached/detached, the notch in the vicinity of the opening portion is elastically deformed to a small extent, and the width of the slit-like notch is opened to a small extent, thereby enabling passage of the shaft portion of the platen roller. As long as a force is not intentionally applied to the notch, the shaft portion of the platen roller does not escape to the outside of the notch since the width of the slit-like notch is narrow.

Further, there is another construction in which the shaft portion of the platen roller is retained in the notch by means of a member surrounding the same, that is, a construction in which at least apart of the opening portion of the notch (entrance portion for platen roller) is blocked to thereby prevent the shaft portion of the platen roller from escaping from the notch. The member for blocking the opening portion of the notch may be the recording head itself (Patent Document 1), or a dedicated lock arm for retaining the shaft portion of the platen roller may be used in addition to the recording head (Patent Document 2). In this construction, by moving the member surrounding the shaft portion of the platen roller (recording head or lock arm), the opening portion of the notch is opened, and attachment/detachment of the platen roller becomes possible.

Patent Document 3 discloses a construction in which a cover frame which can be opened and closed with respect to the frame is provided with a first slit into which the shaft portion of the platen roller is inserted, and the frame is provided with a second slit which is to be combined with the first slit to thereby retain the shaft portion of the platen roller when the cover frame is closed. Further, in this construction, a lock lever rotatably provided to the cover frame is engaged with a pin provided to the frame, thereby making it possible to fix the cover frame to the frame in a state where the platen roller is retained at a position where the first slit and the second slit join each other.

Patent Document 4 discloses a construction in which the platen roller has a rotatably mounted bush lever member, and in which a substantially rectangular shaft portion is formed on the bush lever member, and the opening portion of the notch formed in the frame has a width allowing passage of the shorter side of the substantially rectangular shape shaft portion but not allowing passage of the longer side thereof. In the construction, the shaft portion of the bush lever member is inserted into the notch, with the shorter side of the substantially rectangular shaft portion being opposed to the opening portion of the notch, and then the bush lever member is rotated by 90 degrees to cause the longer side of the substantially rectangular shaft portion to be opposed to the opening portion of the notch, thereby preventing the shaft portion and the platen roller from escaping from the notch.

[Patent Document 1] JP 08-505576 A

[Patent Document 2] JP 2000-318260 A

[Patent Document 3] JP 2000-118060 A

[Patent Document 4] JP 06-071954 A

Of the above-mentioned conventional examples, in the construction in which the opening portion of the slit-like notch into which the platen roller is inserted is narrow, the shaft portion of the platen roller is brought into contact with an end surface of the notch to be slid every time the platen roller is repeatedly attached and detached. Accordingly, there is a fear that the shaft portion of the platen roller is elongated, or the width of the opening portion of the notch is gradually increased due to abrasion, and a clearance is produced between the shaft portion and the notch, which lowers the stability of retaining the platen roller. When the accuracy of retaining the platen roller is lowered as described above, there is a fear that the recording medium provided on the platen roller cannot be accurately pressed at the predetermined position of the recording head with the predetermined pressure, and transportation and recording of the recording medium-cannot be performed with accuracy.

Further, the shaft portion of the platen roller is liable to escape from the opening portion of the notch, and it is more likely that the shaft portion inadvertently escapes from the notch by a small impact or the like and the platen roller is separated from the frame. When the frame and the shaft portion of the platen roller are formed using a material having high strength so as to reduce the abrasion as much as possible, it is difficult to increase the width of the opening portion to allow the shaft portion to pass therethrough, and it is necessary to apply a relatively large force, which deteriorates workability. In addition, in a case where the operator needs to directly apply a force for escaping the platen roller to the outside of the notch, the operation is extremely complicated.

In the construction as disclosed in Patent Document 1, in which the recording head itself is disposed at the position where the opening portion of the notch is blocked to thereby prevent the platen roller from escaping from the notch, a spring member for pressing the recording head against the platen roller with the predetermined pressure to realize satisfactory recording, regulates the attachment/detachment of the platen roller. Accordingly, in a case where the spring member mounted to the recording head is stiff, it is difficult to open the opening portion of the notch, and the operation of attaching/detaching the platen roller is not easy to perform. On the other hand, in a case where the spring member is flexible, the recording head may inadvertently retreat due to some impact, vibration, or the like when a user applies no external force, with the result that the platen roller is allowed to escape from the recess. It is not easy to accurately realize an appropriate spring force fulfilling all the conditions, that is, a condition which prevents the platen roller from escaping from the notch during normal recording, which can cause the recording head to be brought into contact with the platen roller with an appropriate pressure, and which, when the user performs the attachment/detachment operation, easily allows the spring member to undergo elastic deformation so that the platen roller can be inserted into the recess. Further, the spring force may change as a result of a long-term use, which may lead to inconveniences.

In the construction as disclosed in Patent Document 2, in which the opening portion of the notch is blocked by the lock arm, the lock arm is provided so as to surround a part of the shaft portion of the platen roller, in the notch, from the opposite side of the retaining position for retaining the platen roller during recording. In general, the lock arm is provided to the frame and can be moved by an operating lever or the like. Specifically, a fulcrum for the operation of the lock arm is generally positioned in the vicinity of the recording head or at the rear of the recording head. In order to dispose the lock arm at the position where the opening portion of the notch is blocked, there is provided a spring member for urging the lock arm in some cases. In this construction, the fulcrum for the operation of the lock arm, the operating lever, and the spring member are generally provided to the frame, particularly, in the vicinity or at the rear of the recording head. As a result, the space provided in the central portion of the casing is occupied by those members, so it is necessary to provide a space for arranging other members related to various functions of the recording unit, and a transport path for the recording medium is regulated by those members, for example, which reduces a degree of freedom in terms of design and constitutes a hindrance to a reduction in size of the entire apparatus.

Further, the shaft portion of the platen roller slides inside and outside the slit-like notch while being surrounded by the lock arm. Accordingly, the shaft portion of the platen roller tends to be easily abraded through the repeated attachment/detachment operation. When the shaft portion is abraded, even in a state where the platen roller is disposed at the predetermined retaining position, a small clearance is generated between the shaft portion, the lock arm, and the notch, so the platen roller is liable to wobble. As a result, the recording medium provided on the platen roller cannot be accurately pressed with the predetermined pressure at the predetermined retaining position of the recording head, which raises a fear that transportation or recording of the recording medium cannot be performed with accuracy.

In addition, it is necessary to fix the lock arm with a posture of retaining the platen roller at the predetermined retaining position. However, the lock arm is stopped before reaching the correct retaining position, with the result that the lock arm may be in a state of being not completely fixed, that is, a state of being loosely fixed at a halfway position, which is a so-called half-lock state. In this case, the accuracy in positioning of the platen roller is lowered, and in addition, the platen roller is liable to move by a small impact or the like. As a result, the recording medium provided on the platen roller cannot be accurately pressed at the predetermined retaining position of the head with the predetermined pressure, so there is a fear that transportation or recording of the recording medium cannot be performed with accuracy.

In the construction disclosed in Patent Document 3, the operating lever is provided not to the frame but to the cover frame, which is advantageous in that the space provided on the frame side is effectively used. However, the construction in which the platen is separated from the recording head by moving the entire cover frame, involves a large operational stroke, resulting in a operating lever. This leads to a reduction in the degree of freedom in terms of degree of freedom of installation space for the apparatus.

In the construction disclosed in Patent Document 4, the bush lever member, which is relatively large, is rotated by 90 degrees, so a large stroke is involved. Accordingly, it is necessary to provide a movement space for the bush lever member. In addition, in order to fix the bush lever member in a state where the platen roller is inserted in the recess, it is. necessary to provide a construction for engaging an engagement portion of the bush lever member with the opening portion of the casing. Further, it is necessary to strictly maintain the following relationship: the length of the longer side of the shaft portion having the rectangular shape>the width of the opening portion of the recess>the length of the shorter side of the shaft portion. When a difference between those dimensions is slight, the reliability in locking deteriorates, so a reduction in size to an extreme degree is impossible.

SUMMARY OF THE INVENTION

Therefore, it is an object of the present invention is to provide a platen retaining structure capable of solving the above-mentioned various problems inherent in the conventional examples, capable of attaching/detaching a platen easily with a small and simple structure, and securing high reliability in retaining the platen, and a recording unit including the same.

A platen retaining structure according to the present invention is characterized by including: a head for performing processing on a sheet material; a platen facing the head, for supporting the sheet material by sandwiching the sheet material when the sheet material is to be processed by the head; a notch formed in a frame and notched toward an exterior of the frame from a retaining position for retaining a portion to be retained in the platen when the sheet material is to be processed; a pawl provided to the frame, for regulating advancing and escaping directions of the portion to be retained in the platen with respect to the notch; a first urging means for urging the head against the platen; a release arm engaged with the platen or a member for retaining the platen and capable of moving with respect to the frame; and a drive member for moving the release arm along with movement of the head against an urging force of the first urging means, and causing the platen to apply a pressing force in a direction in which the portion to be retained escapes from the notch.

In this structure, the direction in which the portion to be retained in the platen escapes from the notch is restricted by the pawl, and the first urging means applies the pressing force to the platen through the head, thereby suppressing the movement of the portion to be retained in the restricted escaping direction. As a result, it is possible to prevent the portion to be retained in the platen from inadvertently escaping from the notch. In addition, when the head is moved against the urging force of the first urging means, the drive member moves the release arm, thereby escaping the portion to be retained of the plate from the notch.

The drive member may serve as a second urging means for urging the release arm. The second urging means may be disposed such that the urging direction is set as a direction in which, when the urging force applied from the first urging means to the platen through the head is released, the second urging means applies the pressing force to the platen or a member for retaining the platen through the release arm to move the portion to be retained in the platen from the notch in the escaping direction. In this case, only by moving the head, the platen can be pushed out of the notch without a particular operation by the operator.

The second urging means may be provided between the head and the release arm. In addition, the urging force of the first urging means is larger than the urging force of the second urging means.

Alternatively, the drive member may be a connecting member provided between the head and the release arm, for moving the release arm in synchronization with movement of the head.

The first urging means is provided such that the urging direction thereof is set as a direction in which the first urging means applies the pressing force to the platen through the head to press the portion to be retained in the platen at the retaining position in the notch.

The platen retaining structure may include a platen frame serving as the member for retaining the platen and capable of moving with respect to the frame.

A recording unit according to the present invention is characterized by including the platen retaining structure having any one of the above-mentioned structures, in which the head is a recording head for recording on the sheet material.

According to the present invention, the platen can be retained at a predetermined retaining position in the notch of the frame, and the platen can be stably retained even when abrasion is caused in the portion to be retained in the platen. In addition, only by moving the head if necessary, the platen can be easily taken out.

DETAILED DESCRIPTION OF THE PREFERRED EMBODIMENT

Hereinafter, an embodiment mode of the present invention will be described with reference to the drawings.

Figure 1A:
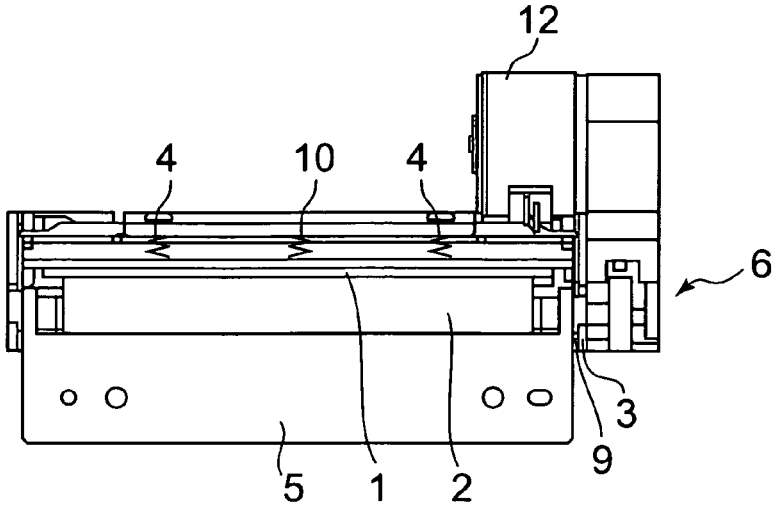
FIG. 1A is a plan view illustrating a main part of a recording unit including a platen retaining structure according to the present invention.
Figure 1B:
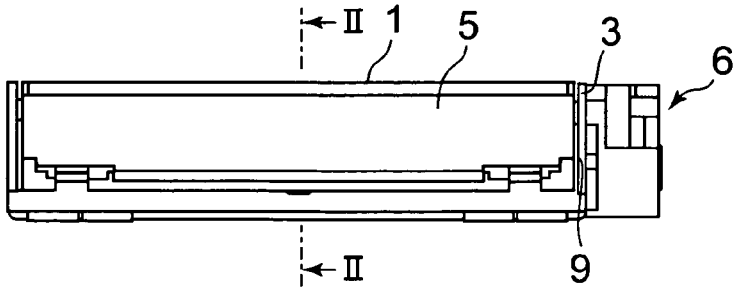
FIG. 1B is a front view thereof.
Figure 1C:
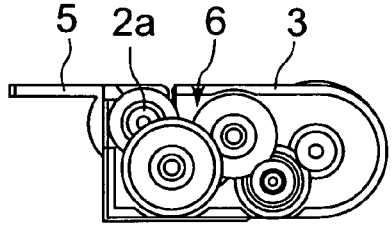
FIG. 1C is a side view thereof.
Figure 2:
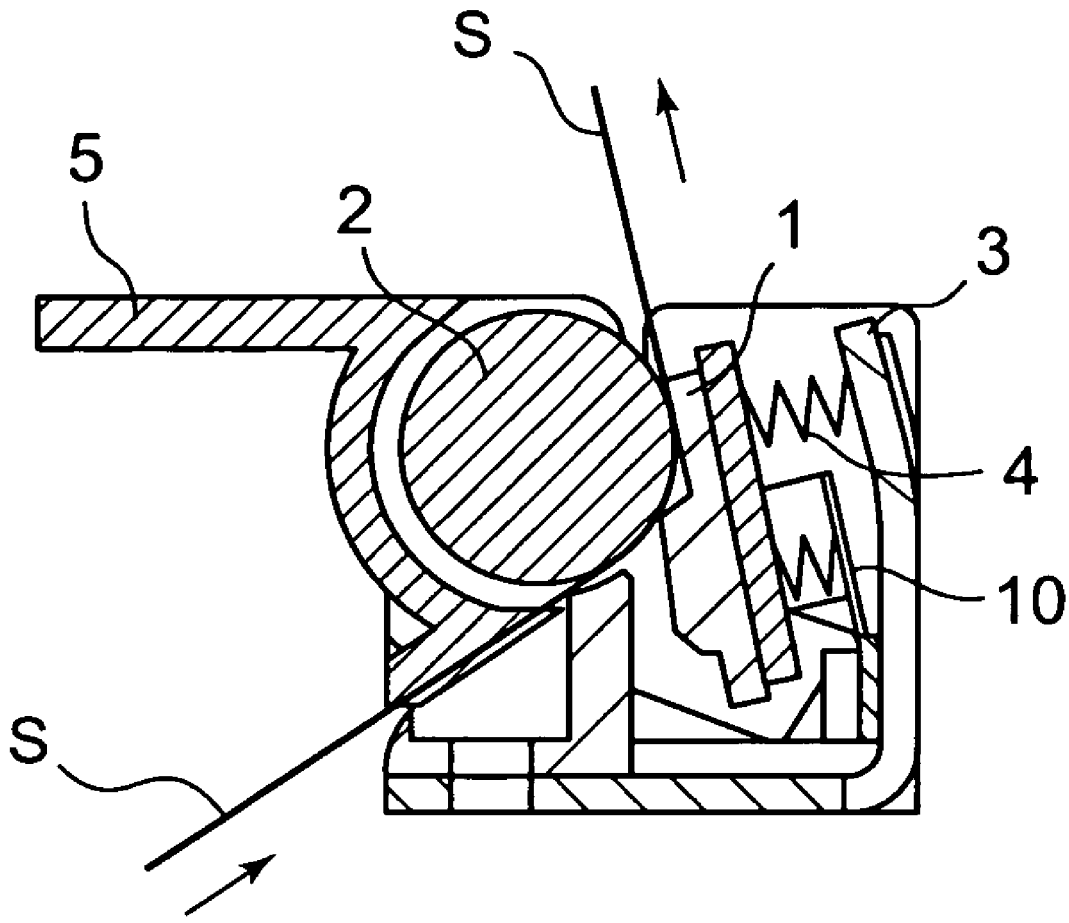
FIG. 2 is a cross sectional view taken along the line II-II of the recording unit shown in FIGS. 1A-1C.

FIGS. 1A-1C and 2 show a main part of a recording unit according to an embodiment of the present invention. In the recording unit, which is in a recordable state, a thermal head 1 which is an example of a recording head for performing recording on a recording medium (sheet material) S as shown in FIG. 2, and a roller-type platen (platen roller 2) for transporting the recording medium S are arranged to be adjacent to each other. Although not shown in the figure, the thermal head 1 includes a large number of heat generating elements and an electrical connection mechanism for transmitting drive signals so as to selectively drive the heat generating elements. Between the thermal head 1 and the frame 3, there is provided a spring member 4 serving as a first urging means for urging the thermal head 1 to be in press contact with the platen roller 2. The platen roller 2 includes a shaft portion 2*a* and an outer peripheral portion 2*b* formed of an elastic body. The thermal head 1 and the platen roller 2 constitute a recording portion.

The thermal head 1 is mounted to the frame 3 such that the thermal head 1 can be moved by a small displacement in a range of elastic deformation of the spring member 4, for example. The platen roller 2 is mounted to a platen frame 5 so as to be rotatable. In addition, the platen frame 5 is mounted so as to be capable of moving (for example, swingably) with respect to the frame 3. On a side of the frame 3, there is provided a gear group 6 for transmitting a rotational driving force from a motor (drive means) 12 to the platen roller 2.

Figure 3A:
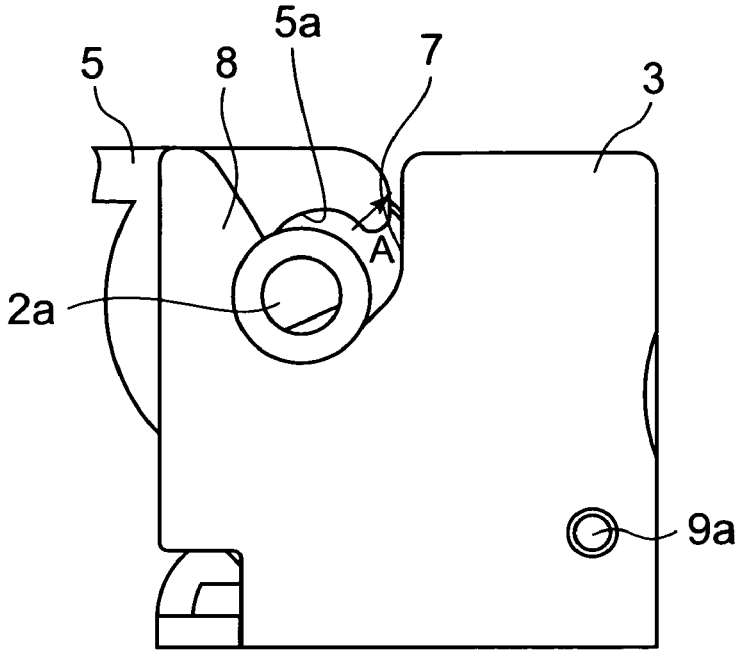
FIG. 3A is a side view illustrating a recordable state of the platen retaining structure of the recording unit shown in FIGS. 1A-1C.
Figure 3B:
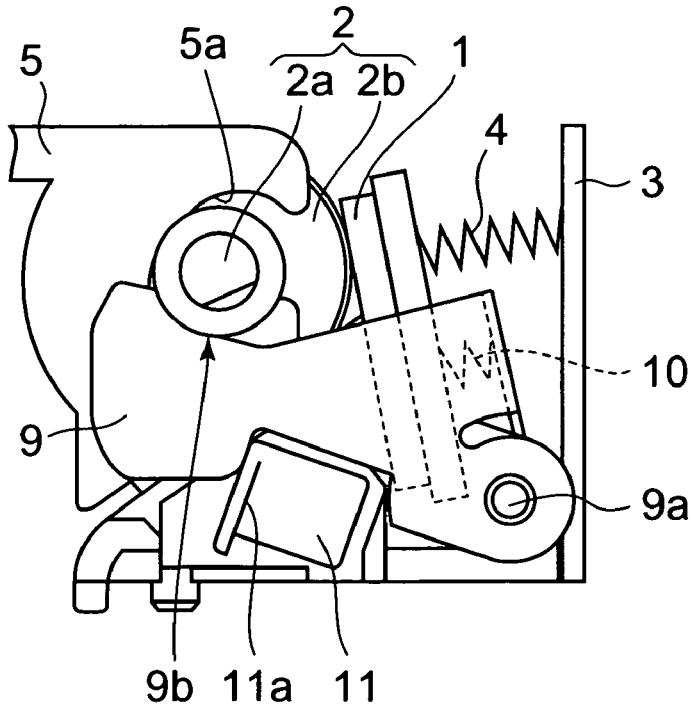
FIG. 3B is a side view thereof in which a part of a frame is omitted from showing.

As shown in FIG. 3A, the frame 3 has a notch 7 formed therein which is notched from the retaining position where the platen roller 2 should be retained during recording, toward outside. In the vicinity of an opening portion of the notch 7, a pawl 8 protruding toward the inside is formed. By the pawl 8, an escaping direction from the retaining position to the opening portion in the notch 7 is restricted to a direction indicated by the arrow A (to be exact, direction within a range of a small angle containing the direction of the arrow A, but in this case, is referred to as "direction of arrow A" for convenience). As a matter of course, an advancing direction into the notch 7 is restricted to an opposite direction of the direction of the arrow A.

As described above, the platen roller 2 is retained in the platen frame 5 so as to be rotatable. Specifically, the platen roller 2 is retained such that the shaft portion 2*a* of the platen roller 2 is inserted in a slit-like recess 5*a* provided in the platen frame 5. The shaft portion 2*a* is retained such that the shaft portion 2*a* can be moved within the slit-like recess 5*a* and cannot escape from the recess 5*a* as long as an external force is not applied. Thus, the shaft portion 2*a* functions as a portion to be retained in the platen roller 2. The platen frame 5 is mounted so as to be movable with respect to the frame 3.

The frame 3 is mounted with a release arm 9 which is swingable with a rocking shaft 9*a* as a center. The release arm 9 includes an engagement portion 9*b* which is engaged with the shaft portion 2*a* of the platen roller 2. In addition, between the release arm 9 and the thermal head 1, a spring member 10 serving as a second urging means is provided.

A switch 11 for position detection is fixed to the frame 3. The switch 11 is switched between an on-state and an off-state, that is, between a case where an intercept 11*a* is brought in contact with the release arm 9 and a case where the intercept 11*a* is not in contact with the release arm 9.

With the above-mentioned structure, in an assembled state shown in FIGS. 1A-1C to 3A-3B, when the sheet material S serving as a thermal recording medium is supplied, the sheet material S is transported through rotation of the platen roller 2 which is driven by the motor 12 through the gear group 6. In this case, the thermal head 1 is urged against the platen roller 2 by the spring member 4, thereby sandwiching the sheet material S between the thermal head 1 and the platen roller 2. Then, the driving signal is transmitted from the electrical connection mechanism not shown to the heat generating element of the thermal head 1 to drive the thermal head 1, thereby performing desirable recording on the sheet material S.

In the recording unit, the shaft portion 2*a* of the platen roller 2 is positioned in the slit-like recess 5*a* of the platen frame 5 and in the notch 7 of the frame 3. When the spring member 4 applies the pressing force to the platen roller 2 through the thermal head 1, the shaft portion 2*a* is pressed at retaining positions shown in FIGS. 3A-3B to be retained. A direction in which the shaft portion 2*a* can escape from the notch 7 is substantially regulated only in the direction of the arrow A by the pawl 8. At least part of the pressing force (urging force) applied by the spring member 4 to the platen roller 2 through the thermal head 1 acts from an opposite side of the direction of the arrow A. Accordingly, by the urging force of the spring member 4, the platen roller 2 and the shaft portion 2*a* are pressed at the retaining positions. shown in FIGS. 3A-3B, and are not made apart from the retaining position. It should be noted that, in this state, the intercept 11*a* of the switch 11 is in a state of being in contact with the release arm, and can detect that the platen roller 2 is positioned at the retaining position.

Figure 4A:
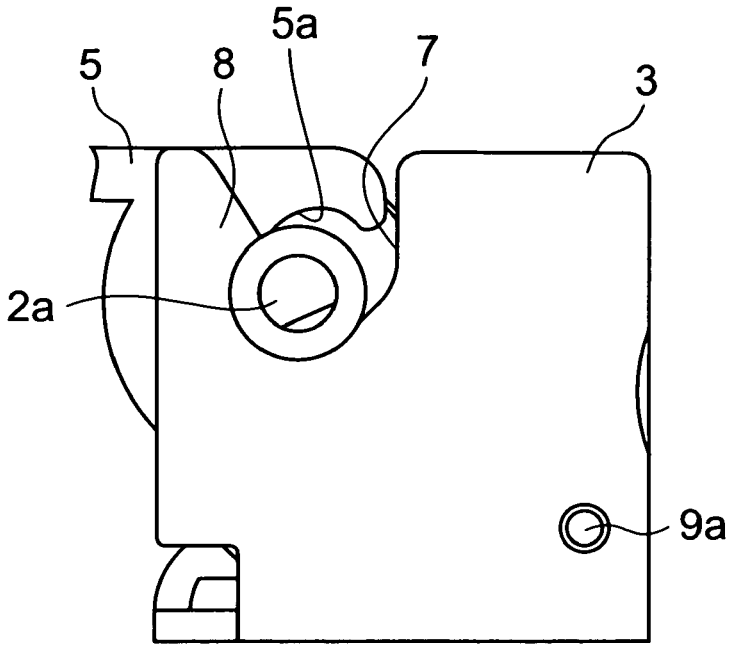
FIG. 4A is a side view illustrating the platen retaining structure of the recording unit shown in FIGS. 1A-1C, with a head being moved.
Figure 4B:
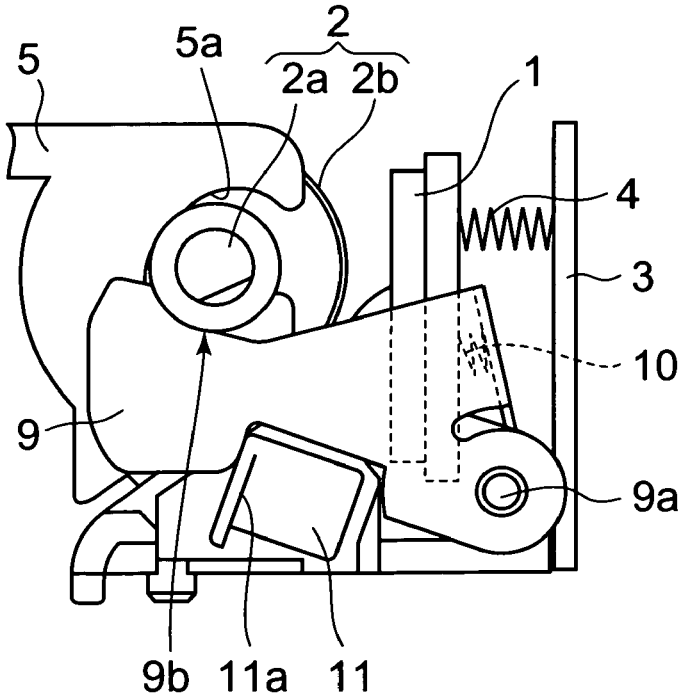
FIG. 4B is a side view thereof in which a part of the frame is omitted from showing.
Figure 5A:
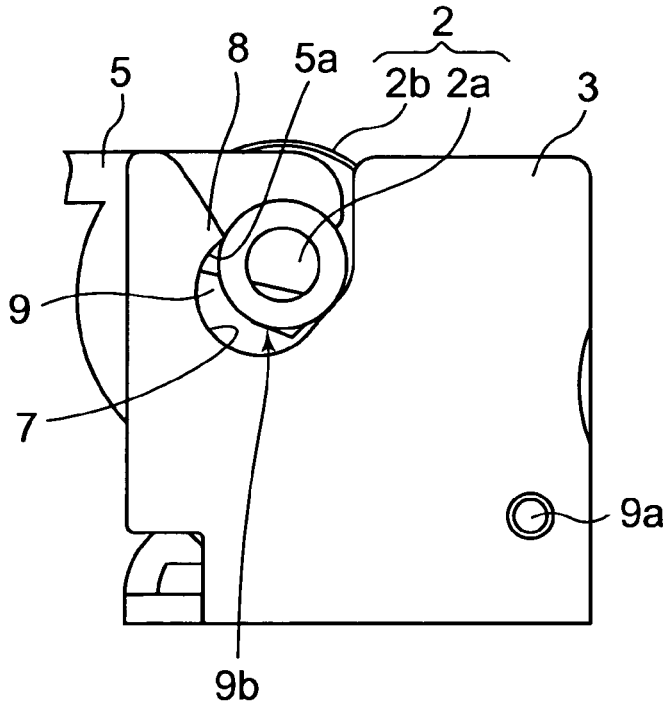
FIG. 5A is a side view illustrating a state of the platen retaining structure of the recording unit shown in FIGS. 1A-1C, with a release arm being moved.
Figure 5B:
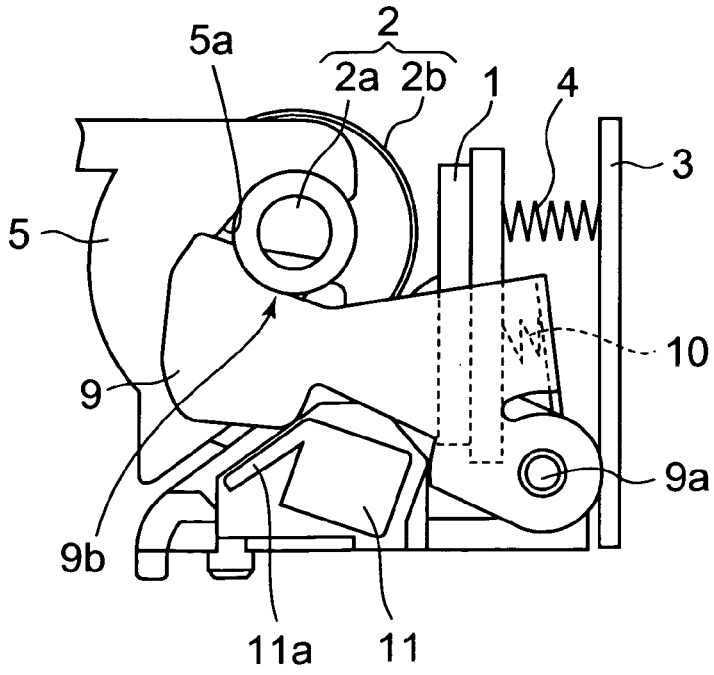
FIG. 5B is a side view thereof in which a part of the frame is omitted from showing.
Figure 6A:
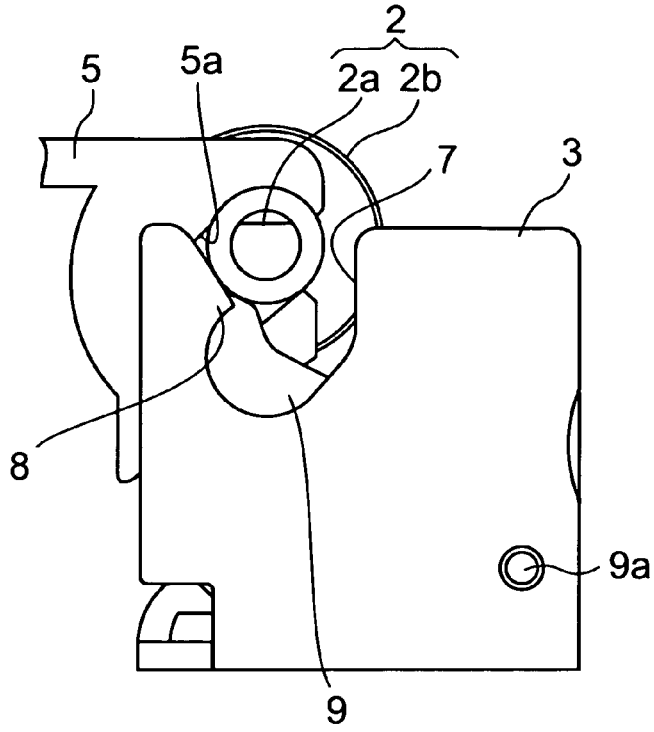
FIG. 6A is a side view illustrating a state of the platen retaining structure of the recording unit shown in FIGS. 1A-1C, with a platen being taken out.
Figure 6B:
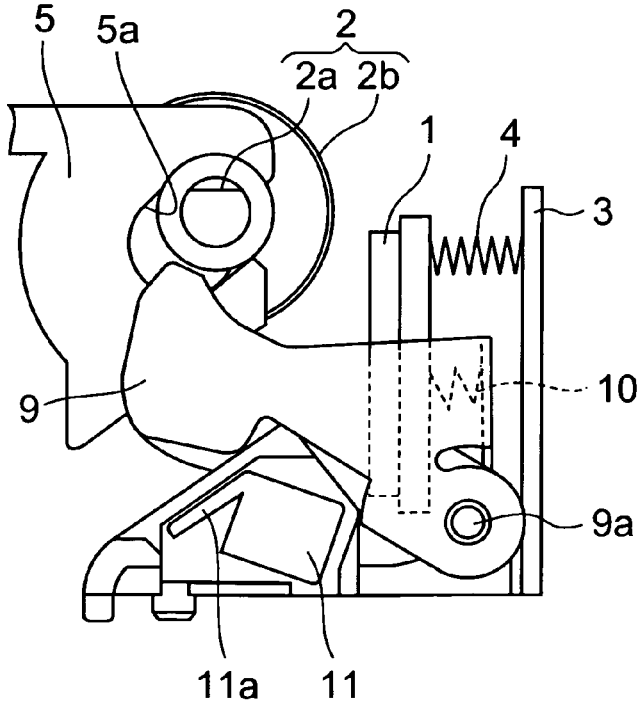
FIG. 6B is a side view thereof in which a part of the frame is omitted from showing.

During a non-recording time, in a case of performing operations such as setting the recording medium by inserting it between the thermal head 1 and the platen roller 2, jamming treatment when jamming (so-called paper jam) of the recording medium is caused, between the thermal head 1 and the platen roller 2, and replacement and maintenance of the thermal head 1 and/or the platen roller 2, the platen roller 2 is separated from the thermal head 1 to be exposed to the outside. In this case, according to this embodiment, first, a lever or the like not shown is operated, and the thermal head 1 is separated from the platen roller 2 against the urging force of the spring member 4 (see FIGS. 4A-4B). At this time, actually, the release arm 9 connected to the thermal head 1 through the spring member 10 is moved in synchronization with the movement of the thermal head 1. In other words, actually, states shown in FIGS. 4A-4B are not obtained, and as shown in FIGS. 5A-5B, the thermal head 1, the spring member 10, and the release arm 9 are moved together. At this time, the engagement portion 9*b* of the release arm 9 is engaged with the shaft portion 2*a* of the platen roller 2 to move the platen roller 2 and the release arm 9 together. As a result, the platen roller 2 is apart from the retaining positions shown in FIGS. 1A-1C to 3A-3B, and the shaft portion 2*a* is moved to the vicinity of the opening position of the notch 7. At this position, a part of the shaft portion 2*a* is positioned on the outside of the pawl 8, and can be released from the regulation by the pawl 8. Then, the platen frame 5 is moved with respect to the frame 3 to cause the shaft portion 2*a* of the platen roller 2 to completely escape from the notch 7 of the frame 3 as shown in FIGS. 6A-6B. In the states shown in FIGS. 5A-5B and 6A-6B, the intercept 11*a* of the switch 11 is not in contact with the release arm, and can detect that the platen roller 2 is not positioned at the retaining position, that is, an unrecordable state.

It should be noted that, FIGS. 4A-4B show the states which are hardly obtained in reality in this embodiment, as described above, but are reference figures for explanation of the movement of the thermal head 1.

After that, the operations such as setting of the recording medium and a jam treatment process, and replacement and maintenance of the thermal head 1 and/or the platen roller 2 are performed. If necessary, the platen roller 2 may be allowed to escape from the slit-like recess 5*a* of the platen frame 5. However, a structure and a method for escaping the platen roller 2 from the recess 5*a* of the platen frame 5 do not constitute features of the present invention, and various conventionally-known means can be employed, so the explanation thereof is omitted.

As described above, as shown in FIGS. 1A-1C to 3A-3B, by the urging force of the spring member 4, the shaft portion 2*a* of the platen roller 2 can be pressed at the predetermined retaining position in the notch 7 to be retained. Even if the diameter of the shaft portion 2*a* is reduced due to abrasion, the state where the shaft portion 2*a* of the platen roller 2 is pressed at the retaining position by the urging force of the spring member 4 can be maintained, thereby causing no backlash. As a matter of course, the shaft portion 2*a* does not escape from the notch 7. Therefore, according to this embodiment, even when a little abrasion is caused in the shaft portion 2*a*, transportation and recording of the sheet material S can be stably performed with accuracy. In addition, by the urging force of the spring member 4, the shaft portion 2*a* is not stopped at a half position and is not in the half-locked state.

As long as the thermal head 1 is made apart from the platen roller 2 by a small distance (about several mm) through an operation of a lever or the like not shown, the platen roller 2 is moved by the urging force of the spring member 10 and the shaft portion 2*a* escapes from the notch, thereby making it possible to take out the platen roller 2 to the outside. In this case, the operator is not required to directly apply a force for moving the platen roller 2.

In addition, unlike a conventional lock arm, the release arm 9 does not surround the shaft portion 2*a*, in the notch 7, from the opposite side of the retaining position for retaining the platen roller 2 during recording, but the release arm 9 pushes the shaft portion 2*a* out of the notch 7. The point is described as follows. The stroke of the conventional lock arm corresponds to the path from the opening portion side (also referred to as "from the head side" or "from the upper side") to the notch 7 side. Accordingly, a space is made so as not to interfere with the stroke, and the space efficiency is lowered, which results in constituting a hindrance to the reduction in size of the recording unit. On the other hand, in the structure of this embodiment, the stroke of the release arm 9 corresponds to the path from the opposite side of the opening portion of the notch 7 (also referred to as "from the opposite side of the head" or "from the rear side") to the outside of the notch 7. Accordingly, it is unnecessary to secure an extra space only for securing the path, which results in contributing to the reduction in size of the recording unit.

Further, in the conventional example, the opening portion of the notch is opened, thereby making it possible to take out the platen roller to the outside. However, it is necessary for the operator to directly perform the operation so as to actually take out the platen roller. While, in this embodiment, the opening portion of the notch is opened, and in addition, when the thermal head 1 is separated from the platen roller 2, the shaft portion 2*a* is pushed out of the notch 7 by the urging force of the spring member 10. Accordingly, the platen roller 2 is automatically pushed out even if the operator does not directly perform the operation.

In a case where the platen roller 2 is inserted into the retaining position of the notch 7 as shown in FIGS. 1A-1C to 3A-3B from the state where the platen roller 2 is taken out of the notch 7, the platen roller 2 may be pushed therein so that the shaft portion 2*a* is placed in the opening portion of the notch. In other words, when the platen roller 2 is pushed therein, the thermal head 1 is pushed by the platen roller 2 and moves by a small distance against the urging force of the spring member 4, thereby inserting the platen roller 2 into the notch. Then, the thermal head 1 is restored by the urging force of the spring member 4 to press the platen roller 2, thereby pressing the shaft portion 2*a* at the retaining position to be fixed. The fixation is performed against the urging force of the spring member 10. Therefore, with regard to at least a component force in the advancing and escaping directions of the shaft portion 2*a*, it is necessary that the urging force of the spring member 4 be larger than the urging force of the spring member 10.

In the embodiment as described above, the spring member 4 is disposed, as the first-urging member, between the thermal head 1 and the frame 3. It is preferable that the spring member 4 bed is posed such that the urging direction thereof is set as a direction in which the spring member 4 applies the pressing force to the platen roller 2 through the thermal head 1 to press the shaft portion 2*a* of the platen roller 2 at the retaining position in the notch 7. It is necessary that the urging force of the spring member 4 have at least a component force in the direction.

In addition, the spring member 10 is disposed, as the second urging member, between the release arm 9 and the thermal head 1. It is preferable that the spring member 10 be disposed such that the urging direction thereof is set as a direction in which the urging force applied from the spring member 4 to the platen roller 2 through the thermal head 1 is released, and when the thermal head 1 is separated from platen roller 2, the pressing force is applied to the platen roller 2 through the release arm 9 to move the shaft portion 2*a* of the platen roller 2 in the escaping direction from the notch 7. At least the urging force of the spring member 10 is required to have a component force in the direction. As a result, the release arm 9 can apply the pressing force in the direction in which the shaft portion 2*a* escapes from the notch 7 with respect to the platen roller 2 along with the movement of the thermal head 1 against the urging force of the spring member 4.

Figure 7A:
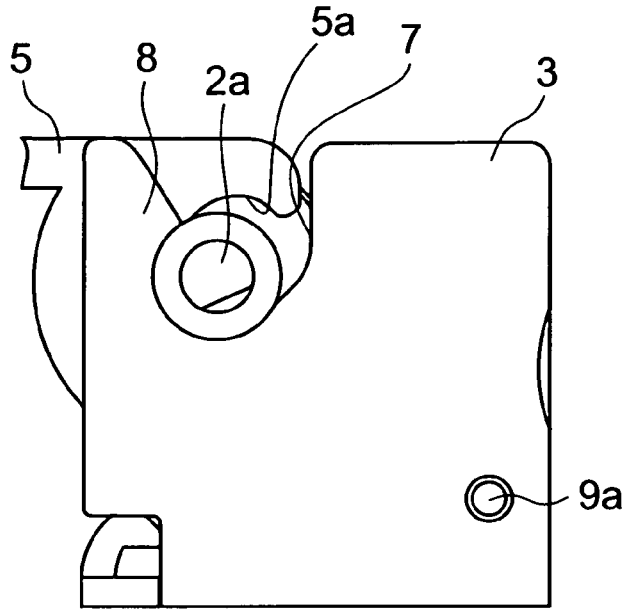
FIG. 7A is a side view illustrating a recordable state of the platen retaining structure of a modified example of the recording unit shown in FIGS. 1A-1C.
Figure 7B:
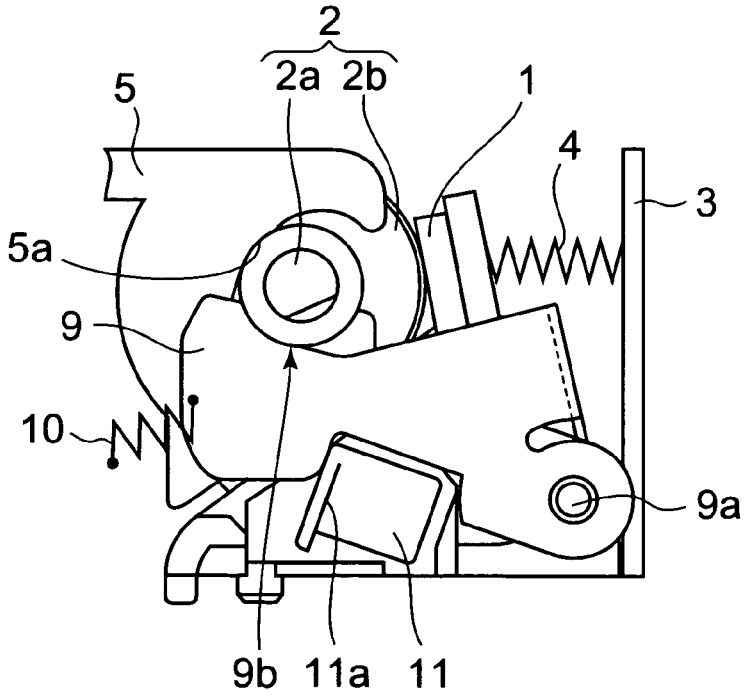
FIG. 7B is a side view thereof in which a part of the frame is omitted from showing.

Note that, for example, as shown in FIGS. 7A-7B, it is also possible to employ a structure including the spring member 10 disposed between the release arm 9 and the frame 3, and having the same urging direction as described above. In this case, the spring member 10 is a compression spring. It should be noted that in FIGS. 7A-7B, a portion of the frame 3 for fixing the spring member 10 is not shown in the figure.

Alternatively, a connecting member for connecting the thermal head 1 and the release arm 9 can be used in place of the spring member 10. In this case, the urging force is not obtained, but the release arm 9 can be moved by following the movement of the thermal head 1 departing from the platen roller 2, and the shaft portion 2*a* engaged with the engagement portion 9*b* can be moved to the opening portion side of the notch 7. In this structure, the urging force (spring force) is not particularly necessary, and the states as shown in FIGS. 5A-5B can be obtained.

It should be noted that in the above-mentioned embodiment, the platen frame 5 for retaining the platen roller 2 is used, but the platen frame 5 can be omitted. Further, in place of the platen roller 2, a non-roller type platen can be used. In this case, the portion to be retained to be held in the notch 7 is not limited to a shaft type, but protrusions having various shapes can be adopted.

The head is not limited to a recording head such as a thermal head or an ink jet head, but a head for thermal activation may be used.

What is claimed is:

1. A platen retaining structure, comprising:

a frame;

a head mounted on the frame for performing a processing operation on a sheet material;

a platen mounted on the frame and facing the head for supporting the sheet material by sandwiching the sheet material when the sheet material is to be processed by the head, the platen having a shaft portion;

a notch formed in the frame for retaining the shaft portion of the platen at a retaining position during a processing operation of the sheet material by the head, the notch being notched from the retaining position toward an exterior of the frame;

a pawl formed on the frame for regulating movement of the shaft portion of the platen in advancing and escaping directions with respect to the notch;

first urging means for urging the head against the platen;

a release arm engaged with the shaft portion of the platen and mounted to undergo movement with respect to the frame; and second urging means for urging the release arm and moving the release arm along with movement of the head away from the platen against an urging force of the first urging means, and for causing the platen to apply a pressing force in a direction in which the shaft portion of the platen escapes from the notch, an urging direction of the second urging means being set as a direction in which the second urging means applies a pressing force to the shaft portion of the platen through the release arm when an urging force applied by the platen through the head from the first urging means is released to thereby move the shaft portion of the platen from the notch.

2. A platen retaining structure according to claim 1; wherein the second urging means is provided between the head and the release arm.

3. A platen retaining structure according to claim 1; wherein the urging force of the first urging means is larger than the urging force of the second urging means.

4. A platen retaining structure according to claim 1; wherein an urging direction of the first urging means is set as a direction in which the first urging means applies the pressing force to the platen through the head to press the shaft portion of the platen at the retaining position in the notch.

5. A platen retaining structure according to claim 1; further comprising a platen frame for retaining the platen and mounted to undergo movement with respect to the frame.

6. A recording unit comprising the platen retaining structure according to claim 1, wherein the head comprises a recording head for recording on the sheet material.

7. A platen retaining structure comprising:

a head that performs a processing operation on a sheet material;

a platen that supports the sheet material during a processing operation of the sheet material, the platen having a shaft portion;

a first urging member that urges the head against the platen;

a frame supporting the head and the platen and formed with a notch and a pawl, the notch having a retaining portion that retains the shaft portion of the platen during a processing operation of the sheet material and an opening portion opening to an exterior of the frame, and the pawl regulating movement of the shaft portion of the platen from the retaining portion to the opening portion of the notch;

a release arm engaged with the shaft portion of the platen and mounted to undergo movement with respect to the frame; and a second urging member that urges the release arm and moves the release arm along with movement of the head away from the platen against an urging force of the first urging member, and that causes the platen to apply a pressing force in a direction in which the shaft portion of the platen escapes from the notch via the opening portion, an urging direction of the second urging member being set as a direction in which the second urging member applies a pressing force to the shaft portion of the platen through the release arm when an urging force applied by the platen through the head from the first urging means is released to thereby move the shaft portion of the platen from the notch.

8. A platen retaining structure according to claim 7;

wherein the notch is notched from the retaining portion toward the opening portion.

9. A platen retaining structure according to claim 8; wherein the second urging member is disposed between the head and the release arm.

10. A platen retaining structure according to claim 8; wherein the urging force of the first urging member is larger than the urging force of the second urging member.

11. A platen retaining structure according to claim 8; wherein an urging direction of the first urging member is set as a direction in which the first urging member applies the pressing force to the platen through the head to press the shaft portion of the platen at the retaining position in the notch.

12. A platen retaining structure according to claim 8; further comprising a platen frame for retaining the platen and mounted to undergo movement relative to the frame.

13. A recording unit comprising the platen retaining structure according to claim 8.

14. A recording unit according to claim 13; wherein the head comprises a recording head for recording on the sheet material.

* * * * *